US010570712B2

(12) United States Patent
Mujica et al.

(10) Patent No.: US 10,570,712 B2
(45) Date of Patent: Feb. 25, 2020

(54) PROTECTING A HYDROCARBON FLUID PIPING SYSTEM

(71) Applicant: Saudi Arabian Oil Company, Dhahran (SA)

(72) Inventors: Pedro Alejandro Mujica, Dhahran (SA); Herman Roberto Cipriano, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 242 days.

(21) Appl. No.: 15/489,371

(22) Filed: Apr. 17, 2017

(65) Prior Publication Data

US 2018/0298738 A1 Oct. 18, 2018

(51) Int. Cl.

| | |
|---|---|
| ***E21B 34/06*** | (2006.01) |
| ***E21B 43/00*** | (2006.01) |
| ***E21B 43/12*** | (2006.01) |
| ***E21B 47/06*** | (2012.01) |
| ***F17D 5/00*** | (2006.01) |

(52) U.S. Cl.

CPC ..... *E21B 43/128* (2013.01); *E21B 34/06* (2013.01); *E21B 43/00* (2013.01); *E21B 47/06* (2013.01); *F17D 5/00* (2013.01)

(58) Field of Classification Search

CPC ..... E21B 34/06; E21B 43/00; E21B 43/128; E21B 47/06; F17D 5/00

See application file for complete search history.

(56) References Cited

U.S. PATENT DOCUMENTS

| | | | |
|---|---|---|---|
| 4,215,746 | A | 8/1980 | Hallden et al. |
| 5,446,369 | A | 8/1995 | Byrne et al. |
| 5,887,657 | A | 3/1999 | Bussear et al. |
| 6,556,027 | B2 | 4/2003 | Banks |

(Continued)

FOREIGN PATENT DOCUMENTS

| | | |
|---|---|---|
| EP | 2592318 | 5/2013 |
| EP | 3054203 | 8/2016 |

(Continued)

OTHER PUBLICATIONS

European Communication Pursuant to Rules 161(1) and 162 EPC issued in European Application No. 17708369.8 on Dec. 18, 2018, 3 pages.

(Continued)

*Primary Examiner* — Matthew R Buck

(74) *Attorney, Agent, or Firm* — Fish & Richardson P.C.

(57) ABSTRACT

Techniques for managing a hydraulic fluid pipeline pressure include measuring a fluid pressure of a hydrocarbon fluid circulating, from a wellbore by a pump positioned in the wellbore, through an above-ground hydrocarbon fluid pipeline network at a plurality of particular locations in the hydrocarbon fluid pipeline network to determine a plurality of measured process pressures; determining that at least half of the plurality of measured process pressures exceed a specified threshold value; and based on the determination, actuating at least one flow control device operable to control the flow of the hydrocarbon fluid in the wellbore to reduce a fluid pressure of the hydrocarbon fluid in the hydrocarbon fluid pipeline network.

21 Claims, 6 Drawing Sheets

(56) References Cited

U.S. PATENT DOCUMENTS

| | | | | |
|---|---|---|---|---|
| 6,880,567 | B2 * | 4/2005 | Klaver | F16K 17/04 137/461 |
| 7,044,156 | B2 * | 5/2006 | Webster | F16K 17/02 137/488 |
| 7,133,727 | B2 | 11/2006 | Van Dyk et al. | |
| 7,823,640 | B2 * | 11/2010 | Flanders | E21B 43/128 166/250.01 |
| 8,051,875 | B2 * | 11/2011 | Edwards | F16K 17/02 137/461 |
| 8,161,993 | B2 * | 4/2012 | Ratcliffe | E21B 41/0007 137/12 |
| 8,201,624 | B2 * | 6/2012 | Flanders | E21B 47/0007 166/250.01 |
| 8,327,874 | B2 * | 12/2012 | Flanders | E21B 33/03 137/461 |
| 8,616,230 | B2 | 12/2013 | Studer | |
| 8,725,434 | B2 * | 5/2014 | Flanders | E21B 34/02 137/487.5 |
| 8,776,609 | B2 | 7/2014 | Dria et al. | |
| 10,221,645 | B2 * | 3/2019 | Elliott | E21B 43/00 |
| 2005/0199286 | A1 * | 9/2005 | Appleford | F17D 3/00 137/487.5 |
| 2009/0013807 | A1 | 1/2009 | Webster | |
| 2009/0101338 | A1 | 4/2009 | Flanders | |
| 2011/0061861 | A1 | 3/2011 | Flanders | |
| 2011/0133942 | A1 | 6/2011 | Flanders | |
| 2011/0144946 | A1 | 6/2011 | Flanders | |
| 2014/0039648 | A1 | 2/2014 | Boult et al. | |
| 2014/0114577 | A1 | 4/2014 | Lopezgarcia et al. | |
| 2014/0212978 | A1 | 7/2014 | Sharpe | |
| 2014/0214326 | A1 | 7/2014 | Samuel et al. | |
| 2014/0261778 | A1 * | 9/2014 | Hamilton | F16K 17/00 137/461 |
| 2015/0027730 | A1 | 1/2015 | Hall et al. | |
| 2017/0329356 | A1 * | 11/2017 | McKeon | G01L 9/0025 |
| 2018/0156004 | A1 * | 6/2018 | Hussain | E21B 33/0355 |
| 2018/0245452 | A1 | 8/2018 | Mujica | |
| 2018/0298738 | A1 | 10/2018 | Mujica et al. | |
| 2019/0219230 | A1 * | 7/2019 | Simon | E21B 43/01 |

FOREIGN PATENT DOCUMENTS

| | | |
|---|---|---|
| WO | 2012054295 | 4/2012 |
| WO | 2012100044 | 7/2012 |
| WO | 2017196420 | 11/2017 |
| WO | 2017218547 | 12/2017 |
| WO | 2018037084 | 3/2018 |

OTHER PUBLICATIONS

Dutuit, Y., et al.; "Probabilistic Assessments in Relationship with Safety Integrity Levels by Using Fault Trees"; Reliability Engineering and System Safety, Elsevier Applied Science; vol. 93, No. 12; Dec. 1, 2008; pp. 1867-1876.

International Search Report and Written Opinion issued in International Application No. PCT/US2018/018976 dated May 4, 2018, 15 pages.

International Search Report and Written Opinion of the International Searching Authority issued in International Application No. PCT/US2017/018048 dated May 2, 2017; 14 pages.

International Search Report and Written Opinion issued in International Application No. PCT/US2018/027134 dated Jul. 6, 2018, 16 pages.

K.B. Woods, :Generating Project Value Through Design for Reliability: On the Development and Implementation of a Potential Value Framework; Thesis, Academic Year 2003-2007, Cranfeld University. Oct. 2007, 274 pages.

Nigel George, "Subsea Production Equipment Satndardisation Initiative," Offshore Technology Conference, OTC-8179-MS, 1996, 2 pages (Abstract only).

Gulf Cooperation Council Examination Report issued in GCC Application No. GC 2017-33199 dated Mar. 19, 2019, 5 pages.

Summers, "Wellhead Flowline Pressure Protection using High Integrity Protective Systems (HIPS)," SIS Tech, available on or before 2017, 7 pages.

* cited by examiner

PROTECTING A HYDROCARBON FLUID PIPING SYSTEM

TECHNICAL FIELD

The present disclosure relates to apparatus, systems, and methods for protecting a hydrocarbon fluids piping system and, more particularly, protecting a hydrocarbon fluids piping system from an overpressure event.

BACKGROUND

Hydrocarbon producing wells (e.g., oil wells, gas wells) often include an artificial lift apparatus, such as a pump that boosts a pressure from the hydrocarbon producing reservoir to allow hydrocarbon production to reach the land surface. In some cases, the pump (or pumps) is capable of generating a wide range of pressures that, in deadhead conditions (e.g., a flow blockage downstream of the pump), may exceed the maximum allowable operating pressure (MAOP) of a downstream piping system (e.g., piping network, manifolds, and equipment). Abnormally high pressures in the downstream piping system can exceed the MAOP of the piping network and the equipment, thereby with potential to damage the system with major consequences.

SUMMARY

In an example implementation, a method for managing a hydraulic fluid pipeline pressure includes measuring a fluid pressure of a hydrocarbon fluid circulating, from a wellbore by a pump positioned in the wellbore, through an above-ground hydrocarbon fluid pipeline network at a plurality of particular locations in the hydrocarbon fluid pipeline network to determine a plurality of measured process pressures; determining that at least half of the plurality of measured process pressures exceed a specified threshold value; and based on the determination, actuating at least one flow control device operable to control the flow of the hydrocarbon fluid in the wellbore to reduce a fluid pressure of the hydrocarbon fluid in the hydrocarbon fluid pipeline network.

In an aspect combinable with the example implementation, actuating at least one flow control device includes adjusting at least one of a motor controller of the pump, a downhole valve fluidly coupled to a work string that includes the pump, or a power switchgear module electrically coupled to the pump.

In another aspect combinable with any of the previous aspects, actuating at least one of a motor controller of the pump, a downhole valve fluidly coupled to a work string that includes the pump, or a power switchgear module electrically coupled to the pump includes at least one of actuating the downhole valve to a closed position to fluidly decouple the pump from the hydrocarbon fluid pipeline network; adjusting the motor controller to slow down or stop the pump; or de-energizing a relay that is electrically coupled to the power switchgear module to electrically decouple the motor controller from the power switchgear module.

In another aspect combinable with any of the previous aspects, adjusting the motor controller to slow down or stop the pump includes adjusting an adjustable frequency drive that is electrically coupled to a motor of the pump.

In another aspect combinable with any of the previous aspects, adjusting the downhole valve to the closed position to fluidly decouple the pump from the hydrocarbon fluid pipeline network includes transmitting at least one signal to a solenoid valve that is fluidly coupled to a fluid actuator of the downhole valve; based on the signal, bleeding a fluid from the fluid actuator; and based on bleeding the fluid, actuating the downhole valve to move to the closed position.

In another aspect combinable with any of the previous aspects, the pump includes an electrical submersible pump.

In another aspect combinable with any of the previous aspects, the plurality of particular locations are downstream of a spec break valve mounted in the hydrocarbon fluid pipeline network, and the plurality of particular locations are adjacent.

In another aspect combinable with any of the previous aspects, the plurality of particular locations include at least three particular locations, and the plurality of measured process pressures include at least three measured process pressures.

In another example implementation, a hydrocarbon pipeline protection system includes a plurality of process pressure sensors configured to couple to an above-ground hydrocarbon fluid pipeline that is fluidly coupled to a wellbore that extends from a terranean surface into a subterranean zone; and a controller configured to communicably couple to the plurality of process pressure sensors and at least one flow control device positioned to adjust a flow of a hydrocarbon fluid that is circulated, by a pump positioned in the wellbore, from the subterranean zone, through the wellbore, and into the hydrocarbon fluid pipeline. The controller is configured to perform operations including receiving a fluid pressure measurement from each of the plurality of process pressure sensors; determining that at least half of the plurality of process pressure measurements exceed a specified threshold value; and based on the determination, controlling the at least one flow control device to control the flow of the hydrocarbon fluid in the wellbore to reduce a fluid pressure of the hydrocarbon fluid in the hydrocarbon fluid pipeline.

In an aspect combinable with the example implementation, the operation of controlling the at least one flow control device includes adjusting at least one of a motor controller of the pump, a downhole valve fluidly coupled to a work string that includes the pump, or a power switchgear module electrically coupled to the pump.

In another aspect combinable with any of the previous aspects, the operation of adjusting at least one of the motor controller of the pump, the downhole valve fluidly coupled to the work string that includes the pump, or the power switchgear module electrically coupled to the pump, includes performing, with the controller, at least one operation including adjusting the downhole valve to a closed position to fluidly decouple the pump from the hydrocarbon fluid pipeline; adjusting the motor controller to stop the pump; or de-energizing a relay that is electrically coupled to the power switchgear module to electrically decouple the motor controller from the power switchgear module.

In another aspect combinable with any of the previous aspects, the operation of adjusting the motor controller to slow down or stop the pump includes electrically isolating, with the controller, an adjustable frequency drive that is electrically coupled to a motor of the pump to stop the pump.

In another aspect combinable with any of the previous aspects, the operation of adjusting the downhole valve to the closed position to fluidly decouple the pump from the hydrocarbon fluid pipeline includes transmitting, from the controller, at least one signal to a solenoid valve that is fluidly coupled to a fluid actuator of the downhole valve, the signal including an instruction to bleed a fluid from the fluid actuator to move the downhole valve to the closed position.

In another aspect combinable with any of the previous aspects, the pump includes an electrical submersible pump.

In another aspect combinable with any of the previous aspects, the plurality of process pressure sensors are configured to couple to the hydrocarbon fluid pipeline downstream of a spec break valve mounted in the hydrocarbon fluid pipeline.

In another aspect combinable with any of the previous aspects, the plurality of process pressure sensors include at least three process pressure sensors.

In another example implementation, a computer-implemented method of managing a hydrocarbon piping network pressure includes receiving, at a controller that includes at least one hardware processor, a plurality of hydrocarbon process pressure measurements from a plurality of pressure sensors mounted downstream of a spec break valve in a hydrocarbon fluid pipeline; determining, with the controller, that at least half of the received plurality of hydrocarbon process pressure measurements exceed a value that is greater than a maximum allowable operating pressure of the hydrocarbon piping network; and based on the determination, transmitting at least one signal, from the controller, to at least one of a motor controller of an electrical submersible pump, a switchgear relay, or a downhole valve actuator, to reduce a flow rate of a hydrocarbon fluid in the piping network.

In an aspect combinable with the example implementation, the at least one signal is transmitted to at least the motor controller and, based on receipt of the signal, the motor controller performs at least one of disconnecting electrical power to the electrical submersible pump or reducing an operational speed of the electrical submersible pump.

In another aspect combinable with any of the previous aspects, the at least one signal is transmitted to at least the downhole valve actuator and, based on receipt of the signal, a downhole valve adjusts to a closed position to substantially stop of the flow rate of the hydrocarbon fluid in the piping network.

In another aspect combinable with any of the previous aspects, the at least one signal is transmitted to at least the switchgear relay and, based on receipt of the signal, the switchgear relay commands a power switchgear to disconnect electrical power to the electrical submersible pump.

In another aspect combinable with any of the previous aspects, the plurality of pressure sensors include at least three pressure sensors.

Implementations according to the present disclosure may include one or more of the following features. For example, a hydrocarbon fluids piping protection system according to the present disclosure may achieve at least a Safety Integrity Level 2 (or higher) designed to protect a hydrocarbon fluids piping system. Further, a hydrocarbon fluids piping protection system according to the present disclosure may help prevent or reduce damage to the hydrocarbon fluids piping system and associate equipment due to overpressure events. As another example, a hydrocarbon fluid piping protection system according to the present disclosure may proactively identify when an abnormal pressure may exceed a maximum allowable operating pressure (MAOP) of the hydrocarbon fluid piping system and initiate an emergency action to isolate or eliminate the source of pressure to allow a hydrocarbon fluid pressure to stay within mechanical capabilities of the hydrocarbon fluid piping network system. Further, the protection system may be used to provide protection in case of low pressure events in the hydrocarbon fluid system due to rupture of the lines leading to losses of pressure containment (leaks) caused by non-overpressure factors in the hydrocarbon fluid system (e.g., external impact).

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes a high integrity protection system (HIPS) and method for a hydrocarbon fluid piping system, such as an above-ground (or underground, buried) hydrocarbon fluid (e.g., oil, gas) piping network that includes a valve that separates a first portion of the piping network that has a relatively high pressure rating (e.g., a fully rated section) from a second portion of the piping network that has a relatively low pressure rating. The HIPS measures multiple process pressure values of a hydrocarbon fluid circulating through the second portion of the piping network (e.g., an underrated section). Based on at least a portion of the measured pressure values exceeding a maximum allowable operating pressure (MAOP) of the second portion of the piping network, the HIPS may initiate one or more actions to reduce or stop a flow rate of the hydrocarbon fluid through the hydrocarbon fluid piping network, thereby containing the pressure (closest to the source of pressure generation) in the fully rated section of the piping network.

Figure 1:
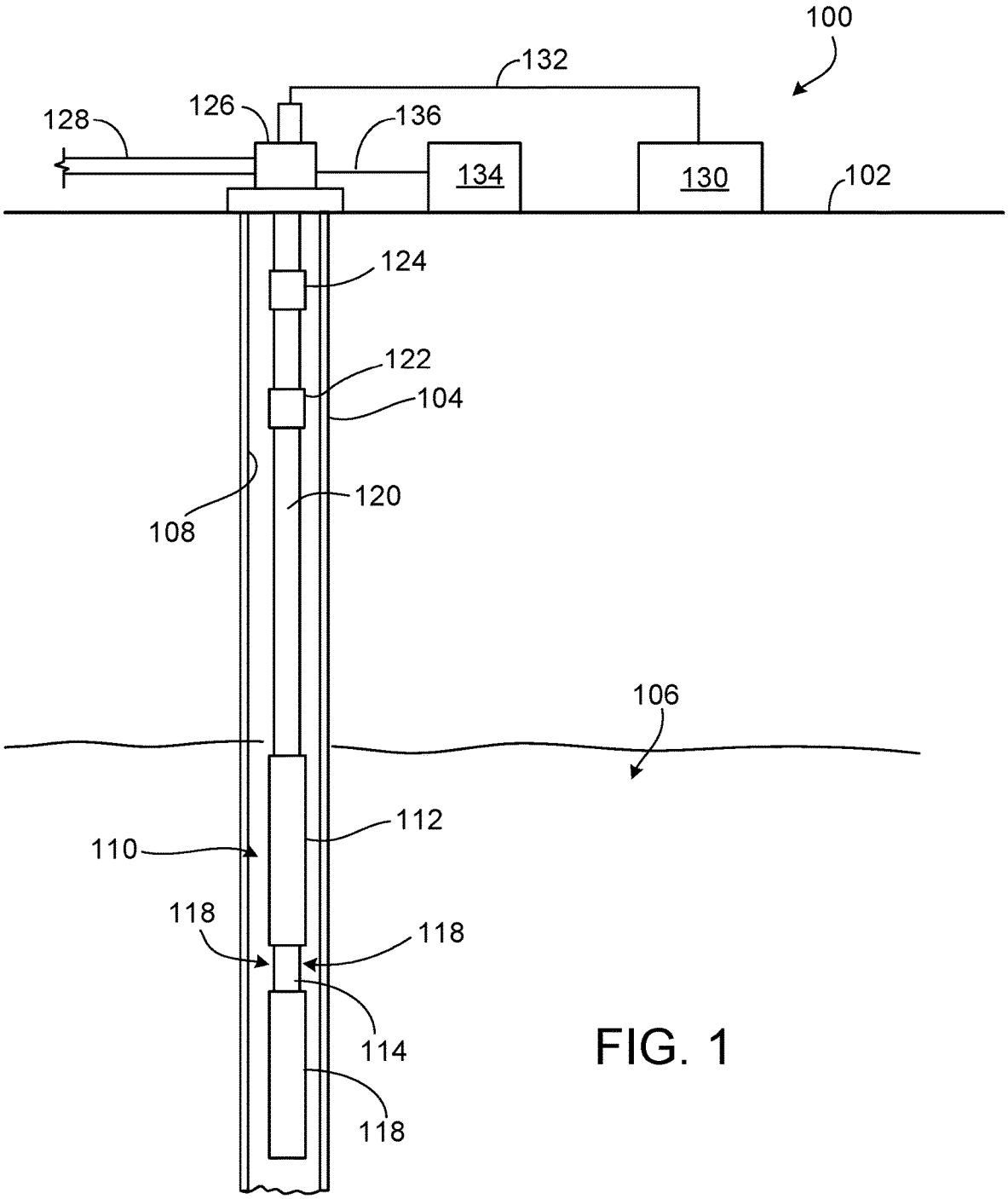
FIG. 1 is a schematic illustration of an example implementation of a hydrocarbon delivery system according to the present disclosure.

FIG. 1 is a schematic illustration of an example implementation of a hydrocarbon delivery system 100. Generally, system 100 may be operated to produce hydrocarbons (e.g., oil, gas, or both) from a subterranean formation 106 (e.g., rock formation, geologic formation) from a wellbore 104 that extends from a terranean surface 102 to the subterranean formation 106. As shown in this example, the wellbore extends from the terranean surface 102 (e.g., a land or onshore surface) in a substantially vertical direction (e.g., accounting for drilling procedures and techniques) to the subterranean formation 106. Although the wellbore 104 shown in FIG. 1 includes only a vertical section, other implementations may include vertical and horizontal sections (joined or intersecting), as well as a curved section that connects the vertical and horizontal portions. Generally, and in alternative implementations, the wellbore 104 can include horizontal, vertical (e.g., only vertical), slant, curved, and other types of wellbore geometries and orientations.

The wellbore 104, in this example, includes a casing 108 that is cemented or otherwise secured to the wellbore wall to define a borehole in the inner volume of the casing 108. The casing 110 may include or represent one or multiple casing types, including or example, conductor casing, surface casing, intermediate casing, and production casing. In alternative implementations, the wellbore 104 can be uncased or include uncased sections.

Perforations (not specifically labeled) can be formed in the casing 108 to allow hydrocarbon fluids to flow into the borehole and to the terranean surface 102 from the subterranean zone 106. Perforations can be formed using shape charges, a perforating gun, and/or other tools. Although illustrated as a generally vertical wellbore, the wellbore 104 may deviate from exactly vertical (e.g., relative to the terranean surface 102) depending on the formation techniques of the wellbore 104, type of rock formation in the subterranean formation 106, and other factors. Generally, the present disclosure contemplates all conventional and novel techniques for forming the wellbore 104 from the surface 102 into the subterranean formation 106.

Subterranean formation 106 includes one or more rock or geologic formations that bear hydrocarbons (e.g., oil, gas) or other fluids (e.g., water) to be produced to the terranean surface 102. For example, the rock or geologic formations can be shale, sandstone, or other type of rock, typically, that may, if needed, be hydraulically fractured (or stimulated with another completion technique) to initiate, increase, or enhance the production of such hydrocarbons.

The example hydrocarbon delivery system 100 includes a pump 110 positioned in the wellbore 104 and coupled within (or to) a working string 120 that extends from the terranean surface 102. In this example implementation, the pump 110 is an electric submersible pump 110 (ESP 110) that includes a pump module 112 coupled to an inlet section 114, which, in turn, is coupled to a motor 114 (other known components not shown for simplicity). Generally, the ESP 110 is operable to provide artificial lift to hydrocarbons 118 from the subterranean zone 106, thereby increasing the fluid pressure of the hydrocarbons 118 for circulation through the working string 120 and to a hydrocarbon piping system 128 at the terranean surface 102.

ESP 110 operates, generally, to circulate the hydrocarbon fluids 118 into the intake 114 with the pump module 112 (e.g., a centrifugal pump module) that is driven by the motor 116. The centrifugal force generated by the pump module 112 lifts the hydrocarbon fluids 118 through the pump module 114 and into the working string 120, and to the hydrocarbon piping system 128. In this example, the motor 116 is or includes an electric induction motor that is powered by an electric cable that extends to the motor 116 from the terranean surface 102 (or other power source, such as a battery or downhole power generator). Although described as an electrical submersible pump, pump 110 may be another form of pump, such as a progressive cavity pump, sucker or surface rod pump, or other positive lift device that is operable to circulate the hydrocarbon fluid 118 from the wellbore 104, through the working string 120, and into the hydrocarbon piping system 128.

In this example implementation, the working string 120 also includes one or more downhole valves 122 and 124. For instance, each of the downhole valves 122 and 124 allow flow of the hydrocarbon fluid 118 through the working string 120, through a wellhead 126, and into the hydrocarbon piping system 128. In some aspects, one of the downhole valves 122 or 124 may be an isolation or shut-off (e.g., non-modulating) valve that operates to fluidly isolate the working string 120 from the hydrocarbon piping system 128. In some aspects, one or both of the downhole valves 122 or 124 are subsurface safety valves (SSSVs).

The illustrated hydrocarbon delivery system 100 includes a power system 130 that supplies electrical power 132 to one or more components of the system 100, including, for example, the pump 110 positioned in the wellbore 104. In some aspects, the power system 130 includes, for example, a connection to or portion of an electrical utility grid, one or more power generators (e.g., as a primary or secondary power source to the utility grid), one or more transformers, and one or more inverters.

In this example, a control system 134 is communicably coupled to one or more components of the hydrocarbon delivery system 100, such as the pump 110, power system 130, and other components, e.g., in the hydrocarbon piping system 128. The control system 134, for example, may be communicably coupled to such components through one or more communication lines 136 (shown, in FIG. 1, as being communicably coupled to the pump 110 or a motor controller of the pump 110). Communication lines 136 may be wired or wireless.

In some aspects, the control system 134 may be or be a part of a high integrity protection system (HIPS) for the hydrocarbon delivery system 100. The HIPS (with example implementations shown in FIGS. 2-5) may include or be coupled to two or more pressure sensors mounted in the hydrocarbon piping system 128, the pump 110 (or a motor controller of the pump 110), as well as particular components of the power system 130. The two or more pressure sensors, for instance, may sense or measure a process pressure of the hydrocarbon fluid 118 that circulates through the hydrocarbon piping system 128 (e.g., downstream of a choke valve and downstream of a piping specification, or "spec break," valve). The HIPS, including the control system 134, may determine that the pressure sensors have sensed a pressure value that is or exceeds a predetermined trip set point (e.g., pre-established according to a portion of the hydrocarbon piping system 128 that has the lowest rated maximum pressure (and the weakest link in the piping network). The HIPS may then initiate one or more actions that result in a stop of the flow, which in turn contains the process pressure of the hydrocarbon fluid 118 circulating through the piping system 128.

In some aspects, the HIPS may be implemented along with the pump control system 134 in compliance with international safety standards (e.g., IEC 61511 and IEC 61508). For example, the control functionality of the pump control system 134 shall, in this example, be separated and segregated from a safety functionality aimed to protect the downstream piping network, as conventional pump control functionality may provide overpressure protection preventing damage to the pump itself, however not intended to offer overpressure protection for the piping network downstream. Moreover, conventional pump safety functionality may be housed in a common control system with the pump control, thus unable to meet standards requirements that require independence and segregation of safety and control functionality for the protection of the pump 110 (e.g., ESP 110) and the downstream piping network. However control and protection of the pump and overpressure protection of the downstream piping network could share the same housing if the control system meet the international safety standards and failure of the control system components may not affect the safety functionality.

Figure 2:
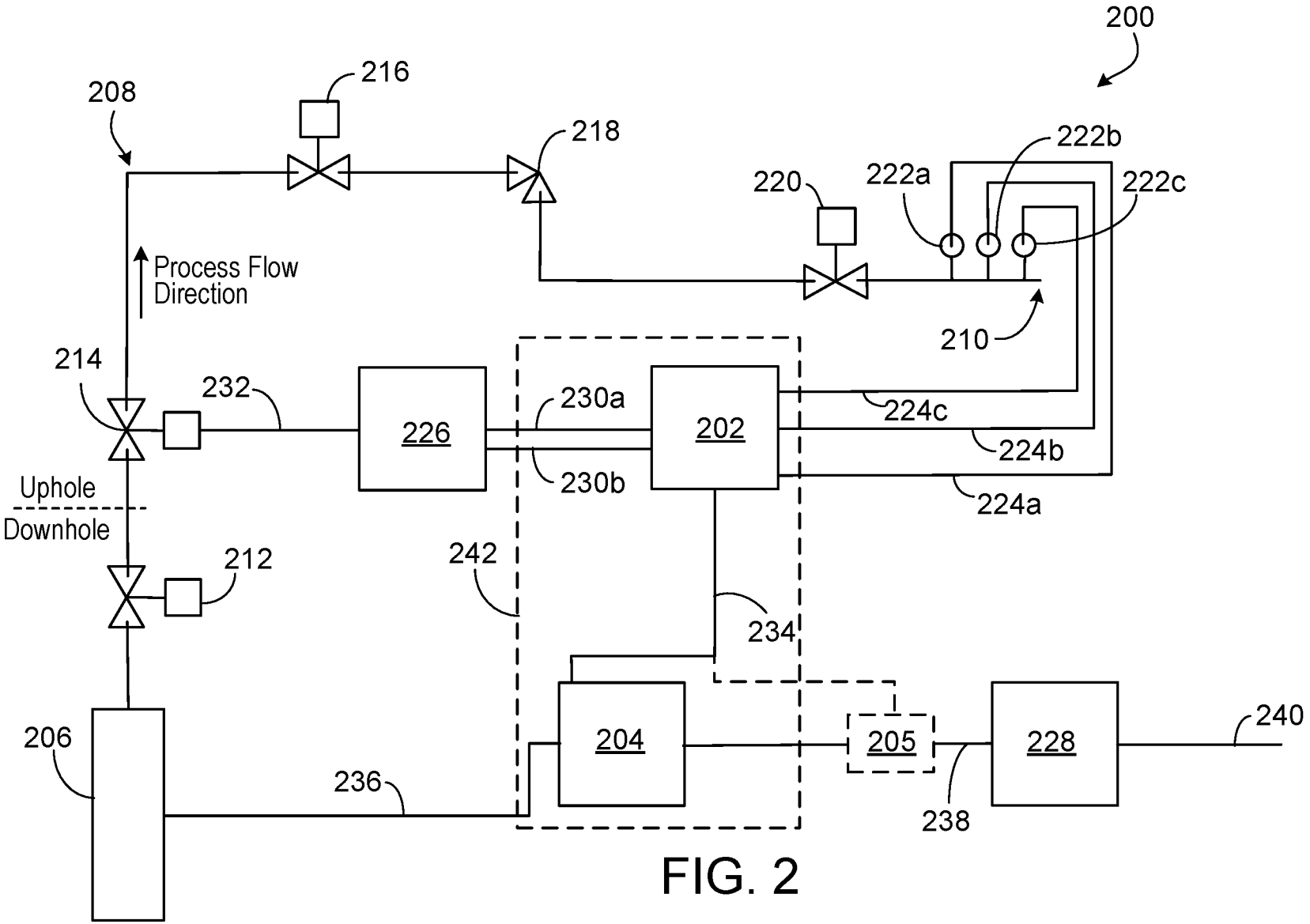
FIG. 2 is a schematic illustration of an example implementation of a high integrity protection system (HIPS) for a hydrocarbon delivery system according to the present disclosure.

FIG. 2 is a schematic illustration of an example implementation of a high integrity protection system (HIPS) 200 for a hydrocarbon delivery system. In some aspects, HIPS 200 may be implemented as all or a part of the control system 134 with the hydrocarbon delivery system 100 shown in FIG. 1. In this example implementation of a HIPS for a hydrocarbon delivery system, multiple pressure sensors may sense or measure a process pressure of a hydrocarbon fluid that circulates through a portion of a hydrocarbon piping system. In the case of an overpressure event as measured by a portion of the multiple pressure sensors and as determined by a safety-certified controller of the HIPS, two flow control (e.g., isolation) devices that are part of or communicably coupled to the HIPS may be adjusted or actuated to stop the flow of the hydrocarbon fluid containing the process pressure.

Turning specifically to FIG. 2, the HIPS 200 includes a safety-certified controller 202 that is communicably coupled through analog inputs 224*a*-224*c* to respective pressure sensors 222*a*-222*c*. In this example, the pressure sensors 222*a*-222*c* are mounted in a downstream hydrocarbon piping system 210 that is fluidly coupled to an upstream hydrocarbon piping system 208 through a spec break valve 220. Generally, the downstream hydrocarbon piping system 210 may have a lower maximum allowable operating pressure than the upstream hydrocarbon piping system 208. For example, the upstream hydrocarbon piping system 208 and the spec break valve 220 may be rated to withstand a deadhead pressure from the ESP 206 (or the well, if flowing naturally without artificial lift from the ESP 206). The downstream hydrocarbon piping system 210, however, may not have a maximum allowable operating pressure rating (or MAOP) at least equal to the deadhead pressure from the ESP 206 (or the well, if flowing naturally without artificial lift from the ESP 206). Thus, while the downstream hydrocarbon piping system 210 may be significantly more cost efficient (due to, e.g., the use of a lower piping class covering long distances to take the hydrocarbon fluids to the processing plants) than the upstream hydrocarbon piping system 208, the piping system 210 has a lower MAOP as compared to the piping system 208.

The upstream hydrocarbon piping system 208 is fluidly coupled to a pump 206 that is positioned in a wellbore to boost the pressure, and lift the hydrocarbon fluid to the upstream hydrocarbon piping system 208, and into the downstream hydrocarbon piping system 210 through the spec break valve 220. In this example, the pump 206 is an electric submersible pump (ESP). In alternative implementations, the pump 206 may be a sucker rod pump or other artificial lift method.

As shown in FIG. 2, the upstream hydrocarbon piping system 208 includes multiple valves that are fluidly coupled to the pump 206 (ESP 206). For example, system 200 includes a subsurface safety valve (SSSV) 212 that may be positioned downhole in a wellbore (e.g., within a flow string with the ESP 206) as well as surface safety valves (SSVs) 214 and 216 that are positioned in the upstream hydrocarbon piping system 208 at a terranean surface. In some aspects, the SSSV 212 may be an isolation or shut-off (e.g., non-modulating) type valve, as well as the SSVs 214 and 216, which in this example, are isolation type valves.

In this example implementation, a choke valve 218 is also positioned in the upstream hydrocarbon piping system 208 between the SSV 216 and the spec break valve 220. Generally, the choke valve 218 is a modulating type valve that is controllable to control a flow rate of hydrocarbon fluid that is flowing through the upstream hydrocarbon piping system 208 (e.g., for production control rather than safety or overpressure control).

As described, in this example, there are three pressure sensors 222*a*-222*c* mounted in the downstream hydrocarbon piping system 210 to measure or sense a process pressure of the hydrocarbon fluid being circulated through the downstream hydrocarbon piping system 210. The pressure sensors 222*a*-222*c* are communicably coupled to the safety-certified controller 202 through respective analog inputs 224*a*-224*c*. The safety-certified controller 202 (e.g., a SIL rated certified programmable logic solver, safety certified solid state logic solver, or safety certified trip amplifiers), in this example, also includes three digital outputs 230*a*-230*b* and 234. As shown, digital outputs 230*a*-230*b* are coupled to a wellhead emergency shutdown module 226, which, in turn, is communicably coupled through a valve control 232 to the SSV 214. In this example, the wellhead emergency shutdown module 226 includes a hydraulic or pneumatic system that provides a pressurized fluid (e.g., hydraulic oil (typically), air, or other fluid) to actuators of the SSSV 212 and SSVs 214 and 216. In this example, such actuators of the SSSV 212 and SSVs 214 and 216 may fail close in that removal of the fluid pressure from the actuators may adjust the SSSV 212 and SSVs 214 and 216 to respective closed positions.

As shown, digital output 234 is communicably coupled from the safety-certified controller 202 to the pump motor controller 204, which is, in turn, communicably coupled to the ESP 206 (e.g., a motor of the ESP 206) through a pump electrical power feed 236. In some aspects, the pump motor controller 204 is or includes an adjustable frequency drive that is operable to adjust a speed of the ESP 206 (e.g., adjust a frequency of the pump motor).

In an alternative implementation of FIG. 2, the safety-certified controller 202 and the pump motor controller 204 may be housed in the same cabinet or enclosure; this may be considered an integrated adjustable frequency drive (AFD) 242 that achieves, e.g., control and protection of the ESP 206, as well as providing the required overpressure safety certified protection for downstream piping network 210. In this alternative implementation, the integrated AFD 242 is shown in dashed line.

The pump motor controller 204, as shown in this example, is electrically coupled through power connection 238 to power switchgear 228. Power switchgear 228, in turn, is electrically coupled to a power source 240, such as an electric utility grid, one or more backup power sources (e.g., generators, renewable power, batteries or otherwise). The power switchgear 228, in some aspects, may provide electrical power to the ESP 206 (through pump motor controller 204) as well as other well site components (e.g., compressors, other pumps, and otherwise).

In an alternative implementation, the power switchgear 228 may be coupled to the pump motor controller 204 through a SIL rated de-energize to trip disconnect switch 205, or switches 205, (shown in dashed lines) that operate (e.g., controlled by the safety-certified controller 202) to electrically decouple the ESP 206 from the power source 240. The power switchgear 228 may also include one or more transformers to step down a voltage of the power source 240 (e.g., which may be high power such as 13.5 kVa or higher) to a lower voltage range (e.g., 120V to 480V or higher).

In an example operation, the HIPS 200 may function, generally, to detect an overpressure event in the downstream hydrocarbon piping system 210 (e.g., pressure of hydrocarbon fluid in the piping that approaches the MAOP of the piping system 210) and, based on the detection, close one or more components of the system 200 to reduce the pressure of the hydrocarbon fluid flowing through the downstream hydrocarbon piping system 210. For instance, the analog inputs 224*a*-224*c* (e.g., 4-20 mA or 0-10 VDC) from the respective pressure sensors 222*a*-222*c* are monitored at the safety-certified controller 202 during circulation of the hydrocarbon fluid, by the ESP 206, through the upstream hydrocarbon piping system 208, and into the downstream hydrocarbon piping system 210 downstream of the spec break valve 220. Each of the analog inputs 224*a*-224*c* provides an analog pressure measurement to the safety-certified controller 202. In this example, the safety-certified controller 202 determines if there is an overpressure event (e.g., pressure of the hydrocarbon fluid in the downstream piping system 210 approaches a MAOP of the piping system 210) detected by a voting configuration of the sensing elements on a two out of three configuration. Thus, if at least two of the three pressure sensors 222*a*-222*c* measure a process pressure that is close to exceed the MAOP, then the safety-certified controller 202 may determine that an overpressure event may occur. In such a case, the safety-certified controller 202 may de-energize the digital outputs 230*a*-230*b* and 234 to the wellhead emergency shutdown module 226 and electrical power to the pump motor controller 204 isolating the power to the ESP 206. By de-energizing, the wellhead emergency shutdown module 226 may, in turn, bleed a pressurized fluid from one or more valve actuators for the SSSV 212, SSV 214, or 216, thereby closing the one or more valves. In this example, the wellhead emergency shutdown module 226 is shown coupled to the SSV 214 (as an isolation valve). In alternative aspects, the wellhead emergency shutdown module 226 may also be coupled to the SSSV 212 and/or the SSV 216, or all three. Further, by de-energizing, the pump motor controller 204 may effectively remove power from the ESP 206, thereby stopping the flow of the hydrocarbon fluid being pumped (by the ESP 206) through the upstream hydrocarbon piping system 208 and into the downstream hydrocarbon piping system 210. As the flow rate decreases and eventually approaches zero, the overpressure event is removed without damage to the downstream hydrocarbon piping system 210. An alternative configuration to achieve the electrical isolation of the pump 206 could be by cutting the electrical power via a SIL rated de-energize to trip disconnect switch 205 (e.g., as shown in the dashed line configuration shown in FIG. 2).

In some aspects, the HIPS 200 may provide for a level 3 Safety Integrity Level (SIL 3). For example, the SIL of a particular HIPS may be related to an expected risk reduction factor range that the safety instrumented function needs to and can achieve. In this example, SIL 3 is expected to achieve a risk reduction factor of between 1,000 and 10,000 (e.g., between 0.001-0.0001 probability of failure on demand). SIL 3 may be achieved here, for example, due to diversity in the control of both the SSV 214 and the pump motor controller 204 based on the overpressure event determination by the safety-certified controller 202, as well as the two out of three voting configuration of the pressure sensors 222*a*-222*c*.

Figure 3:
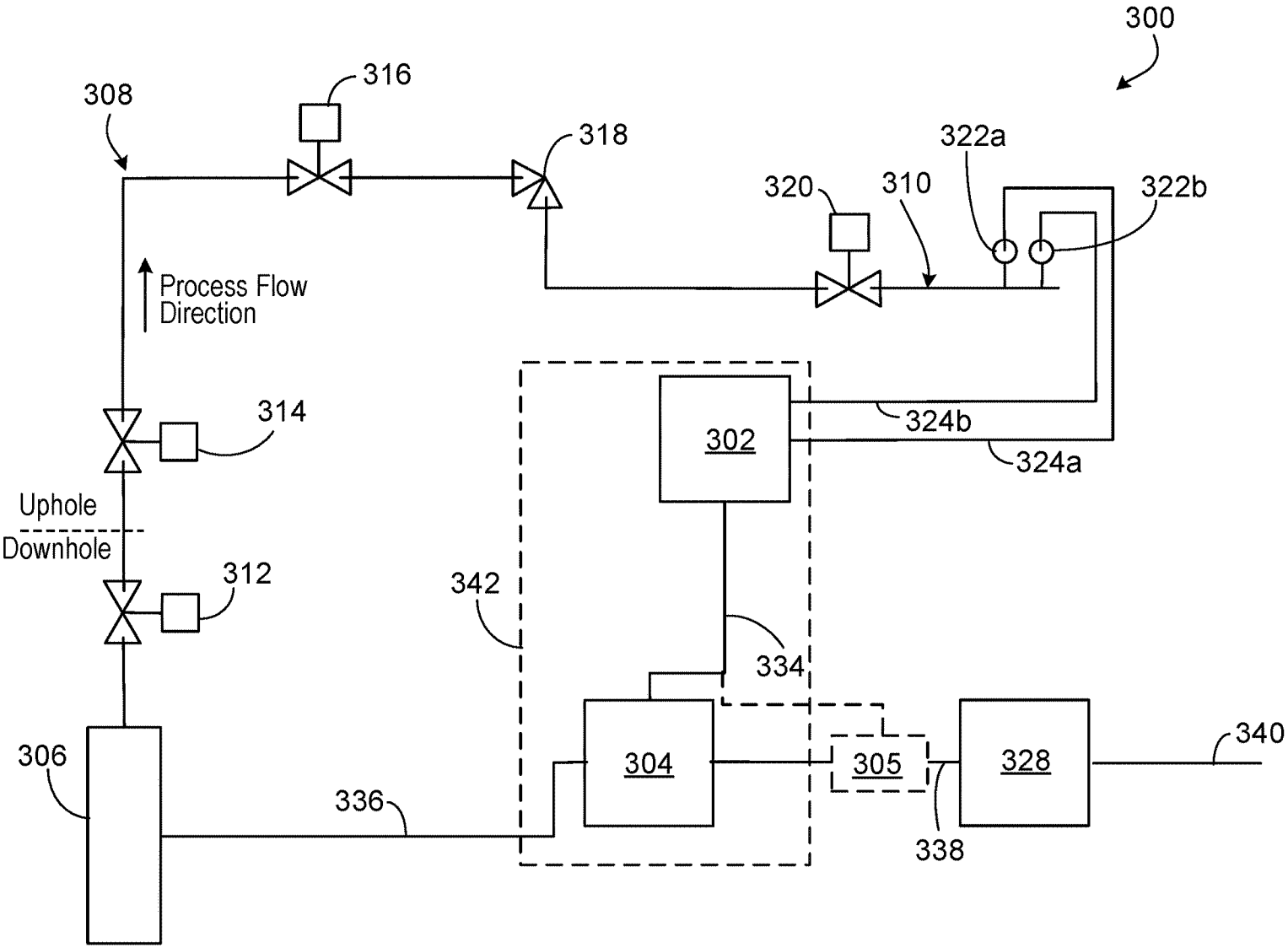
FIG. 3 is a schematic illustration of another example implementation of a HIPS for a hydrocarbon delivery system according to the present disclosure.

FIG. 3 is a schematic illustration of another example implementation of a HIPS 300 for a hydrocarbon delivery system. In some aspects, HIPS 300 may be implemented as all or a part of the control system 134 with the hydrocarbon delivery system 100 shown in FIG. 1. In this example implementation of a HIPS for a hydrocarbon delivery system, multiple pressure sensors may sense or measure a process pressure of a hydrocarbon fluid that circulates through a portion of a piping system. In the case of an overpressure event as measured by a portion of the multiple pressure sensors and as determined by a safety-certified controller of the HIPS, a flow isolation device that is part of or communicably coupled to the HIPS may be actuated to contain the process pressure of the piping system.

Turning specifically to FIG. 3, the HIPS 300 includes a safety-certified controller 302 that is communicably coupled through analog inputs 324*a*-324*b* to respective pressure sensors 322*a*-322*b*. In this example, the pressure sensors 322*a*-322*b* are mounted in a downstream hydrocarbon piping system 310 that is fluidly coupled to an upstream hydrocarbon piping system 308 through a spec break valve 320. Generally, the downstream piping system 310 may have a lower maximum allowable operating pressure (MAOP) than the upstream hydrocarbon piping system 308. For example, the upstream hydrocarbon piping system 308 and the spec break valve 320 may be rated to withstand a deadhead pressure from the ESP 306 (or the well, if flowing naturally without artificial lift from the ESP 306). The downstream hydrocarbon piping system 310, however, may not have a design pressure rating (or MAOP) at least equal to the deadhead pressure from the ESP 306 (or the well, if flowing naturally without artificial lift from the ESP 306). Thus, while the downstream hydrocarbon piping system 310 may be significantly more cost efficient (due to, e.g., the use of a lower piping class covering the vast amount of piping length) than the upstream hydrocarbon piping system 308, the piping system 310 has a lower MAOP as compared to the piping system 308.

The upstream hydrocarbon piping system 308 is fluidly coupled to a pump 306 that is positioned in a wellbore to circulate hydrocarbon fluid from a subterranean zone, through a production string fluidly coupled to the upstream hydrocarbon piping system 308, and into the downstream hydrocarbon piping system 310 through the spec break valve 320. In this example, the pump 306 is an electric submersible pump (ESP). In alternative implementations, the pump 306 may be a sucker rod pump or other artificial lift method.

As shown in FIG. 3, the upstream hydrocarbon piping system 308 includes multiple valves that are fluidly coupled to the pump 306 (ESP 306). For example, system 300 includes a subsurface safety valve (SSSV) 312 that may be positioned downhole in a wellbore (e.g., within a work string with the ESP 306) as well as surface safety valves (SSVs) 314 and 316 that are positioned in the upstream hydrocarbon piping system 308 at a terranean surface. In some aspects, the SSSV 312 may be an isolation or shut-off (e.g., non-modulating) type valve, as well as the SSVs 314 and 316, may be isolation type valves.

In this example implementation, a choke valve 318 is also positioned in the upstream hydrocarbon piping system 308 between the SSV 316 and the spec break valve 320. Generally, the choke valve 318 is a modulating type valve that is controllable to control a flow rate of hydrocarbon fluid that is flowing through the upstream hydrocarbon piping system 308 (e.g., for production control rather than safety or overpressure control).

As described, in this example, there are two pressure sensors 322*a*-322*b* mounted in the downstream hydrocarbon piping system 310 to measure or sense a process pressure of the hydrocarbon fluid being circulated through the downstream piping system 310. The pressure sensors 322*a*-322*b* are communicably coupled to the safety-certified controller 302 through respective analog inputs 324*a*-324*b*. The safety-certified controller 302, in this example, also includes a digital output 334. As shown, digital output 334 is communicably coupled from the safety-certified controller 302 to the pump motor controller 304, which is, in turn, communicably coupled to the ESP 306 (e.g., a motor of the ESP 306) through an electrical pump control 336. In some aspects, the pump motor controller 304 is or includes an adjustable frequency drive that is operable to adjust a speed of the ESP 306 (e.g., adjust a frequency of the pump motor) to, in turn, adjust a flow rate of the hydrocarbon fluid circulated by the ESP 306.

In an alternative implementation of FIG. 3, the safety-certified controller 302 and the pump motor controller 304 may be housed in the same cabinet or enclosure; this may be considered an integrated adjustable frequency drive (AFD) 342 that achieves, e.g., control and protection of the ESP 306, as well as providing the required overpressure safety certified protection for downstream piping network 310. In this alternative implementation, the integrated AFD 342 is shown in dashed line.

The pump motor controller 304, as shown in this example, is electrically coupled through power connection 338 to power switchgear 328. Power switchgear 328, in turn, is electrically coupled to a power source 340, such as an electric utility grid, one or more backup power sources (e.g., generators, renewable power, batteries or otherwise). The power switchgear 328, in some aspects, may provide electrical power to the ESP 306 (through pump motor controller 304) as well as other well site components (e.g., compressors, other pumps, and otherwise).

In an alternative implementation, the power switchgear 328 may be coupled to the pump motor controller 304 through a SIL rated de-energize to trip disconnect switch 305, or switches 305, (shown in dashed lines) that operate (e.g., controlled by the safety-certified controller 302) to electrically decouple the ESP 306 from the power source 340. The power switchgear 328 may also include one or more transformers to step down a voltage of the power source 340 (e.g., which may be high power such as 13.5 kVa or higher) to a lower voltage range (e.g., 120V to 480V or higher).

In an example operation, the HIPS 300 may function, generally, to detect an overpressure event in the downstream piping system 310 (e.g., process pressure of hydrocarbon fluid in the piping that exceeds the MAOP of the piping system 310) and, based on the detection, stop the flow via the component of the system 300 to reduce process pressure of the hydrocarbon fluid flowing through the downstream piping system 310. For instance, the analog inputs 324*a*-324*b* (e.g., 4-20 mA or 0-10 VDC) from the respective pressure sensors 322*a*-322*b* are monitored at the safety-certified controller 302 during circulation of the hydrocarbon fluid by the ESP 306, through the upstream piping system 308, and into the downstream piping system 310 downstream of the spec break valve 320. Each of the analog inputs 324*a*-324*b* provides an analog pressure measurement to the safety-certified controller 302. In this example, the safety-certified controller 302 determines if there is an overpressure event (e.g., hydrocarbon fluid exceeds a MAOP of the piping system 310) based on a one out of two configuration. Thus, if at least one of the two pressure sensors 322*a*-322*b* measure a process pressure that may exceed the MAOP (or a predefined pressure trip value giving a safety margin to prevent exceeding the MAOP), then the safety-certified controller 302 may determine that an overpressure event may occur. In alternative implementations, there may be more pressure sensors 322, and a two out of three, three out of five, or other voting scheme may be used.

In the case of an overpressure determination, the safety-certified controller 302 may de-energize digital output 334 (remove a high signal), which in turn will cut the electrical supply to the pump motor controller 304. By de-energizing, the pump motor controller 304 may effectively remove power from the ESP 306, thereby stopping flow of the hydrocarbon fluid being pumped (by the ESP 306) through the upstream piping system 308 and into the downstream piping system 310. As the flow rate decreases and eventually approaches zero, the overpressure event is removed without damage to the downstream hydrocarbon piping system 310. An alternative configuration to achieve the electrical isolation of the pump 306 could be by cutting the electrical power via a SIL rated de-energize to trip disconnect switch 305 (e.g., as shown in the dashed line configuration shown in FIG. 3).

In some aspects, the HIPS 300 may provide for a level 2 SIL. In this example, SIL 2 is expected to achieve a risk reduction factor of between 100 and 1,000 (e.g., between 0.01-0.001 probability of failure on demand). SIL 2 may be achieved here, for example, due to single disconnection of the power supply to the pump motor controller 304 based on the overpressure event determination by the safety-certified controller 302, as well as the one out of two voting configuration of the pressure sensors 322*a*-322*b*.

Figure 4:
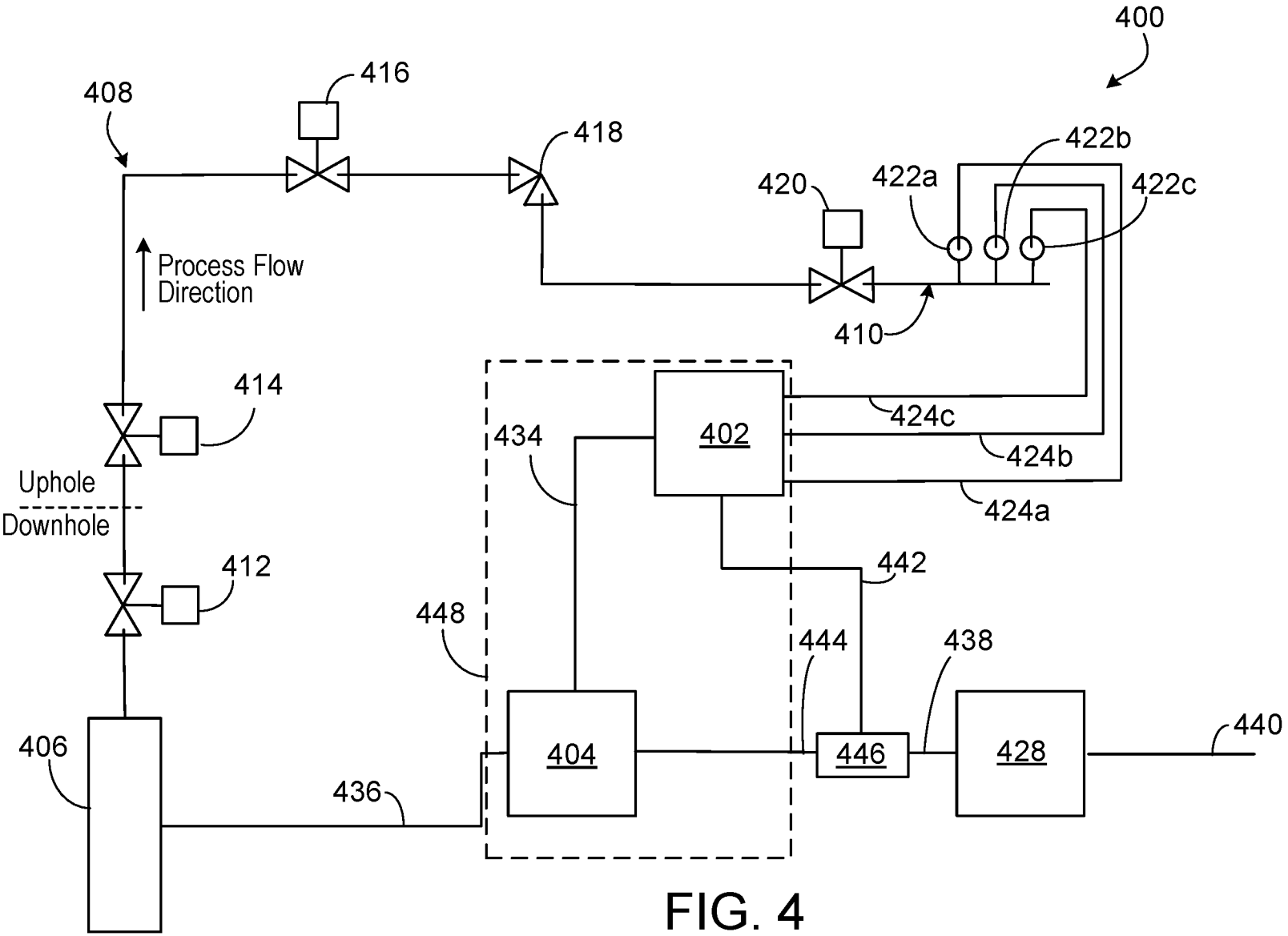
FIG. 4 is a schematic illustration of another example implementation of a HIPS for a hydrocarbon delivery system according to the present disclosure.

FIG. 4 is a schematic illustration of another example implementation of a HIPS 400 for a hydrocarbon delivery system. In some aspects, HIPS 400 may be implemented as all or a part of the control system 134 with the hydrocarbon delivery system 100 shown in FIG. 1. In this example implementation of a HIPS for a hydrocarbon delivery system, multiple pressure sensors may sense or measure a process pressure of a hydrocarbon fluid that circulates through a portion of a piping system. In the case of an overpressure event as measured by a portion of the multiple pressure sensors and as determined by a safety-certified controller of the HIPS, two flow control devices that are part of or communicably coupled to the HIPS may be actuated to stop the process pressure of the hydrocarbon system.

Turning specifically to FIG. 4, the HIPS 400 includes a safety-certified controller 402 that is communicably coupled through analog inputs 424*a*-424*c* to respective pressure sensors 422*a*-422*c*. In this example, the pressure sensors 422*a*-422*c* are mounted in a downstream piping system 410 that is fluidly coupled to an upstream piping system 408 through a spec break valve 420. Generally, the downstream hydrocarbon piping system 410 may have a lower maximum allowable operating pressure (MAOP) than the upstream hydrocarbon piping system 408. For example, the upstream hydrocarbon piping system 408 and the spec break valve 420 may be rated to withstand a deadhead pressure from the ESP 406 (or the well, if flowing naturally without artificial lift from the ESP 406). The downstream hydrocarbon piping system 410, however, may not have a MAOP at least equal to the deadhead pressure from the ESP 406 (or the well, if flowing naturally without artificial lift from the ESP 406). Thus, while the downstream hydrocarbon piping system 410 may be significantly more cost efficient (due to, e.g., the use of a lower piping class covering vast length of piping network) than the upstream hydrocarbon piping system 408, the piping system 410 has a lower MAOP as compared to the piping system 408.

The upstream hydrocarbon piping system 408 is fluidly coupled to a pump 406 that is positioned in a wellbore to circulate hydrocarbon fluid from a subterranean zone, through a production string fluidly coupled to the upstream hydrocarbon piping system 408, and into the downstream hydrocarbon piping system 410 through the spec break valve 420. In this example, the pump 406 is an electric submersible pump (ESP). In alternative implementations, the pump 406 may be a sucker rod pump or other artificial lift methods.

As shown in FIG. 4, the upstream hydrocarbon piping system 408 includes multiple valves that are fluidly coupled to the pump 406 (ESP 406). For example, system 400 includes a subsurface safety valve (SSSV) 412 that may be positioned downhole in a wellbore (e.g., within a work string with the ESP 406) as well as surface safety valves (SSVs) 414 and 416 that are positioned in the upstream hydrocarbon piping system 408 at a terranean surface. In some aspects, the SSSV 412 may be an isolation or shut-off (e.g., non-modulating) type valve, while the SSVs 414 and 416 may be, e.g., isolation type valves.

In this example implementation, a choke valve 418 is also positioned in the upstream hydrocarbon piping system 408 between the SSV 416 and the spec break valve 420. Generally, the choke valve 418 is a modulating type valve that is controllable to control a flow rate of hydrocarbon fluid that is flowing through the upstream hydrocarbon piping system 408 (e.g., for production control rather than safety or overpressure control).

As described, in this example, there are three pressure sensors 422*a*-422*c* mounted in the downstream hydrocarbon piping system 410 to measure or sense a process pressure of the hydrocarbon fluid being circulated through the downstream piping system 410. The pressure sensors 422*a*-422*c* are communicably coupled to the safety-certified controller 402 through respective analog inputs 424*a*-424*c*. The safety-certified controller 402, in this example, also includes two digital outputs 434 and 442. Digital output 434 is communicably coupled from the safety-certified controller 402 to a pump motor controller 404, which is, in turn, communicably coupled to the ESP 406 (e.g., a motor of the ESP 406) through an electrical feed to the 406. In some aspects, the pump motor controller 404 is or includes an adjustable frequency drive that is operable to adjust a speed of the ESP 406 (e.g., adjust a frequency of the pump motor) to, in turn, adjust a flow rate of the hydrocarbon fluid circulated by the ESP 406.

In an alternative implementation of FIG. 4, the safety-certified controller 402 and the pump motor controller 404 may be housed in the same cabinet or enclosure; this may be considered an integrated adjustable frequency drive (AFD) 448 that achieves, e.g., control and protection of the ESP 406, as well as providing the required overpressure safety certified protection for downstream piping network 410. In this alternative implementation, the integrated AFD 448 is shown in dashed line.

The pump motor controller 404, as shown in this example, is electrically coupled through power connection 438 to power switchgear 428. Power switchgear 428, in turn, is electrically coupled to a power source 440, such as an electric utility grid, one or more backup power sources (e.g., generators, renewable power, batteries or otherwise). The power switchgear 428, in some aspects, may provide electrical power to the ESP 406 (through pump motor controller 404) as well as other well site components (e.g., compressors, other pumps, and otherwise). In some aspects, the power switchgear 428 may include one or more SIL rated de-energize to trip disconnect switch 446 that operate to electrically decouple the well site components (e.g., including the ESP 406) from the power source 440, as well as one or more transformers to step down a voltage of the power source 440 (e.g., which may be high power such as 13.5 kVa or higher) to a lower voltage range (e.g., 120V to 480V or higher). As shown, digital output 442 is coupled to the pump motor controller 404 through safety certified de-energize to trip low voltage disconnect switch 446.

In an example operation, the HIPS 400 may function, generally, to detect an overpressure event in the downstream piping system 410 (e.g., process pressure of hydrocarbon fluid that exceeds the MAOP of the piping system 410) and, based on the detection, actuate one or more electrical components of the system 400 to contain the pressure of the hydrocarbon fluid flowing through the downstream piping system 410. For instance, the analog inputs 424*a*-424*c* (e.g., 4-20 mA or 0-10 VDC) from the respective pressure sensors 422*a*-422*c* are monitored at the safety-certified controller 402 during circulation of the hydrocarbon fluid, by the ESP 406, through the upstream hydrocarbon piping system 408, and into the downstream piping system 410 downstream of the spec break valve 420. Each of the analog inputs 424*a*-424*c* provides an analog pressure measurement to the safety-certified controller 402. In this example, the safety-certified controller 402 determines if there is an overpressure event (e.g., process pressure of the hydrocarbon fluid approach or exceeds an MAOP of downstream piping system 410) based on a two out of three configuration. Thus, if at least two of the three pressure sensors 422*a*-422*c* measure a process pressure that may exceed the MAOP (or a predetermined trip setting value below the MAOP), then the safety-certified controller 402 may determine that an overpressure event may occur. In such a case, the safety-certified controller 402 may de-energize digital outputs 434 to the pump motor controller 404 and 442 (remove a high signal) via safety-certified de-energize to trip low voltage disconnect switch 446, respectively. By de-energizing, the pump motor controller 404 may effectively remove power from the ESP 406, thereby stopping a flow rate of the hydrocarbon fluid being pumped (by the ESP 406) through the upstream piping system 408 and into the downstream piping system 410. Further, by de-energizing, safety-certified de-energize to trip low voltage disconnect switch 446 may trip the power from switchgear 428, thereby removing electrical power from the pump motor controller 404 (and in turn, the ESP 406). For instance, the ESP 406 may be electrically decoupled from the power source 440. As the flow rate of the hydrocarbon fluid decreases (e.g., due to loss of power and/or deactivation of the ESP 406) and eventually approaches zero, the overpressure event is removed without damage to the downstream piping system 410.

In some aspects, the HIPS 400 may provide for a level 3 Safety Integrity Level (SIL 3). In this example, SIL 3 is expected to achieve a risk reduction factor of between 1,000 and 10,000 (e.g., between 0.001-0.0001 probability of failure on demand). SIL 3 may be achieved here, for example, due to diversity in the trip of both the power final elements via SIL rated low voltage disconnect switch 446 and the pump motor controller 404 based on the overpressure event determination by the safety-certified controller 402, as well as the two out of three voting configuration of the pressure sensors 422*a*-422*c*.

Figure 5:
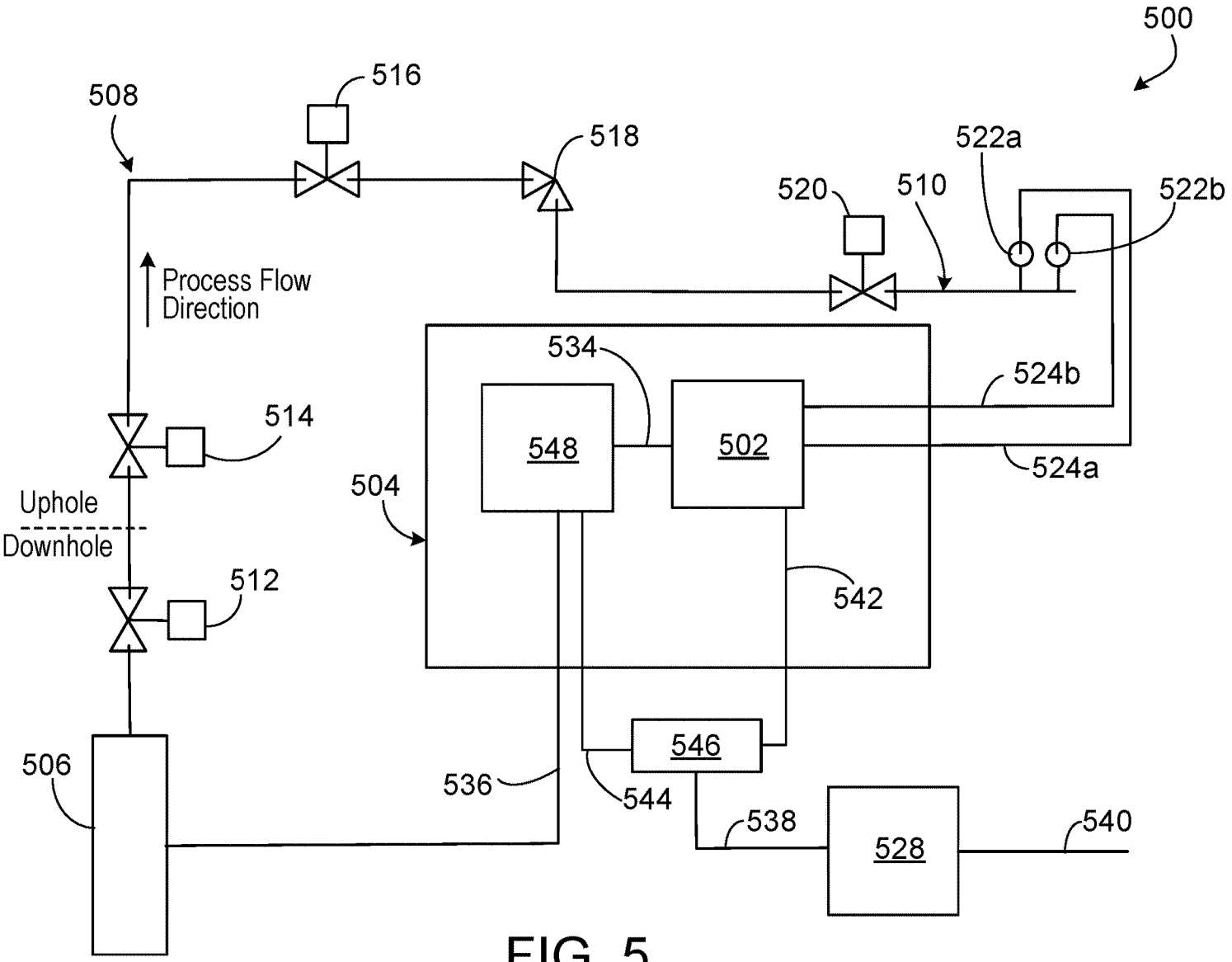
FIG. 5 is a schematic illustration of another example implementation of a HIPS for a hydrocarbon delivery system according to the present disclosure.

FIG. 5 is a schematic illustration of another example implementation of a HIPS 500 for a hydrocarbon delivery system. In some aspects, HIPS 500 may be implemented as all or a part of the control system 134 with the hydrocarbon delivery system 100 shown in FIG. 1. In this example implementation of a HIPS for a hydrocarbon delivery system, multiple pressure sensors may sense or measure a process pressure of a hydrocarbon fluid that circulates through a portion of a piping system. In the case of an overpressure event as measured by multiple pressure sensors and as determined by a safety-certified controller of the HIPS, two flow control devices that are part of or communicably coupled to the HIPS may be actuated to reduce the process pressure of the hydrocarbon fluid in the piping network downstream.

Turning specifically to FIG. 5, the HIPS 500 includes a safety-certified controller 502 that is communicably coupled through analog inputs 524*a*-524*b* to respective pressure sensors 522*a*-522*b*. In this example, the pressure sensors 522*a*-522*b* are mounted in a downstream piping system 510 that is fluidly coupled to an upstream piping system 508 through a spec break valve 520. Generally, the downstream hydrocarbon piping system 510 may have a lower maximum allowable operating pressure (MAOP) than the upstream piping system 508. For example, the upstream piping system 508 and the spec break valve 520 may be rated to withstand a deadhead pressure from the ESP 506 (or the well, if flowing naturally without artificial lift from the ESP 506). The downstream piping system 510, however, may not have a MAOP at least equal to the deadhead pressure from the ESP 506 (or the well, if flowing naturally without artificial lift from the ESP 506). Thus, while the downstream hydrocarbon piping system 510 may be significantly more cost efficient (due to the use of a lower piping class covering the vast length of the piping network) than the upstream piping system 508, the piping system 510 has a lower MAOP as compared to the piping system 508.

The upstream hydrocarbon piping system 508 is fluidly coupled to a pump 506 that is positioned in a wellbore to circulate hydrocarbon fluid from a subterranean zone, through a production string fluidly coupled to the upstream hydrocarbon piping system 508, and into the downstream hydrocarbon piping system 510 through the spec break valve 520. In this example, the pump 506 is an electric submersible pump (ESP). In alternative implementations, the pump 506 may be a sucker rod pump or other artificial lift methods.

As shown in FIG. 5, the upstream hydrocarbon piping system 508 includes multiple valves that are fluidly coupled to the pump 506 (ESP 506). For example, system 500 includes a subsurface safety valve (SSSV) 512 that may be positioned downhole in a wellbore (e.g., within a work string with the ESP 506) as well as surface safety valves (SSVs) 514 and 516 that are positioned in the upstream piping system 508 at a terranean surface. In some aspects, the SSSV 512 may be an isolation or shut-off (e.g., non-modulating) type valve, while the SSVs 514 and 516 may be isolation type valves.

In this example implementation, a choke valve 518 is also positioned in the upstream hydrocarbon piping system 508 between the SSV 516 and the spec break valve 520. Generally, the choke valve 518 is a modulating type valve that is controllable to control a flow rate of hydrocarbon fluid that is flowing through the upstream piping system 508 (e.g., for production control rather than safety or overpressure control).

As described, in this example, there are two pressure sensors 522*a*-522*b* mounted in the downstream piping system 510 to measure or sense a process pressure of the hydrocarbon fluid being circulated through the downstream piping system 510. The pressure sensors 522*a*-522*b* are communicably coupled to the safety-certified controller 502 through respective analog inputs 524*a*-524*b*. The safety-certified controller 502, in this example, also includes two digital outputs 534 and 542. Digital output 534 is communicably coupled from the safety-certified controller 502 to a pump motor controller 548, which is, in turn, communicably coupled to the ESP 506 (e.g., a motor of the ESP 506) through a pump control 536. In some aspects, the pump motor controller 548 is or includes an adjustable frequency drive that is operable to adjust a speed of the ESP 506 (e.g., adjust a frequency of the pump motor) to, in turn, adjust a flow rate of the hydrocarbon fluid circulated by the ESP 506.

In this example implementation, the safety-certified controller 502 and pump motor control 548 are housed in the same enclosure or cabinet of an adjustable frequency drive (AFD) 504 that powers and controls the ESP 506. This may be considered an integrated adjustable frequency drive (AFD) 504 (e.g., achieving control and protection of the ESP 506, as well as providing the required overpressure safety certified protection for downstream piping network 510). The pump motor controller 548, as shown in this example, electrically feeds and controls the ESP 506. The AFD 504 receives electrical power from the power switchgear 528 through power connection 538.

Power switchgear 528, in turn, is electrically coupled to a power source 540, such as an electric utility grid, one or more backup power sources (e.g., generators, renewable power, batteries or otherwise). The power switchgear 528, in some aspects, may provide electrical power to the ESP 506 (through the pump motor controller 548 housed in AFD 504) as well as other well site components (e.g., compressors, other pumps, and otherwise). In some aspects, the power switchgear 528 may include one or more safety-certified low voltage disconnect switch that operate to electrically decouple the well site components (e.g., including the ESP 506) from the power source 540, as well as one or more transformers to step down a voltage of the power source 540 (e.g., which may be high power such as 13.5 kVa or higher) to a lower voltage range (e.g., 120V to 480V or higher). As shown, digital output 542 is coupled to the pump motor controller 548 through a SIL rated low voltage de-energize to trip disconnect switch 546. The SIL rated low-voltage disconnect switch 546 is coupled to the pump motor controller 548 through a line 544.

In an example operation, the HIPS 500 may function, generally, to detect an overpressure event in the downstream piping system 510 (e.g., process pressure of hydrocarbon fluid in the piping that exceeds the MAOP of the piping system 510) and, based on the detection, actuate one or more electrical components of the system 500 leading to cut the power to the ESP 506 to reduce a pressure of the hydrocarbon fluid flowing through the downstream piping system 510. For instance, the analog inputs 524*a*-524*b* (e.g., 4-20 mA or 0-10 VDC) from the respective pressure sensors 522*a*-522*b* are monitored at the safety-certified controller 502 during circulation of the hydrocarbon fluid, by the ESP 506, through the upstream piping system 508, and into the downstream piping system 510 downstream of the spec break valve 520. Each of the analog inputs 524*a*-524*b* provides an analog signal (that equates to pressure) to the safety-certified controller 502. In this example, the safety-certified controller 502 determines if there may be an overpressure event (e.g., hydrocarbon fluid in downstream piping system 510 may approach or exceed a MAOP of the piping system 510) based on a one out of two voting configuration. Thus, if at least one of the two pressure sensors 522*a*-522*b* measure a fluid pressure that exceeds (or reach a pre-determined trip pressure setting below the MAOP) the MAOP, then the safety-certified controller 502 may determine that an overpressure event may occur. In such a case, the safety-certified controller 502 may de-energize digital outputs 534 and 542 (remove a high signal) to the pump motor controller 548 and to the SIL rated de-energized to trip low voltage disconnect switch 546, respectively. By de-energizing, the pump motor controller 548 may effectively remove power from the ESP 506, thereby stopping a flow rate of the hydrocarbon fluid being pumped (by the ESP 506) through the upstream piping system 508 and into the downstream piping system 510. Further, by de-energizing, the SIL rated de-energized to trip low voltage disconnect switch 546 may disconnect the electrical power from the switchgear 528, thereby removing electrical power from the pump motor controller 548 of the AFD 504 (and in turn, the ESP 506). For instance, the ESP 506 may be electrically decoupled from the power source 540. As the flow rate of the hydrocarbon fluid decreases (e.g., due to loss of power and/or deactivation of the ESP 506) and eventually approaches zero, the overpressure event is removed without damage to the downstream piping system 510.

In some aspects, the HIPS 500 may provide for a level 3 Safety Integrity Level (SIL 3). In this example, SIL 3 is expected to achieve a risk reduction factor of between 1,000 and 10,000 (e.g., between 0.001-0.0001 probability of failure on demand). SIL 3 may be achieved here, for example, due to diversity in the electrical isolation of both the SIL rated de-energize to trip low voltage disconnect switch 546 and the pump motor controller 548 based on the overpressure event determination by the safety-certified controller 502, as well as the one out of two voting configuration of the pressure sensors 522*a*-522*b*. Further, the HIPS 500 may be efficiently implemented in existing well site components, namely, the AFD 504 that controls the ESP 506.

Figure 6:
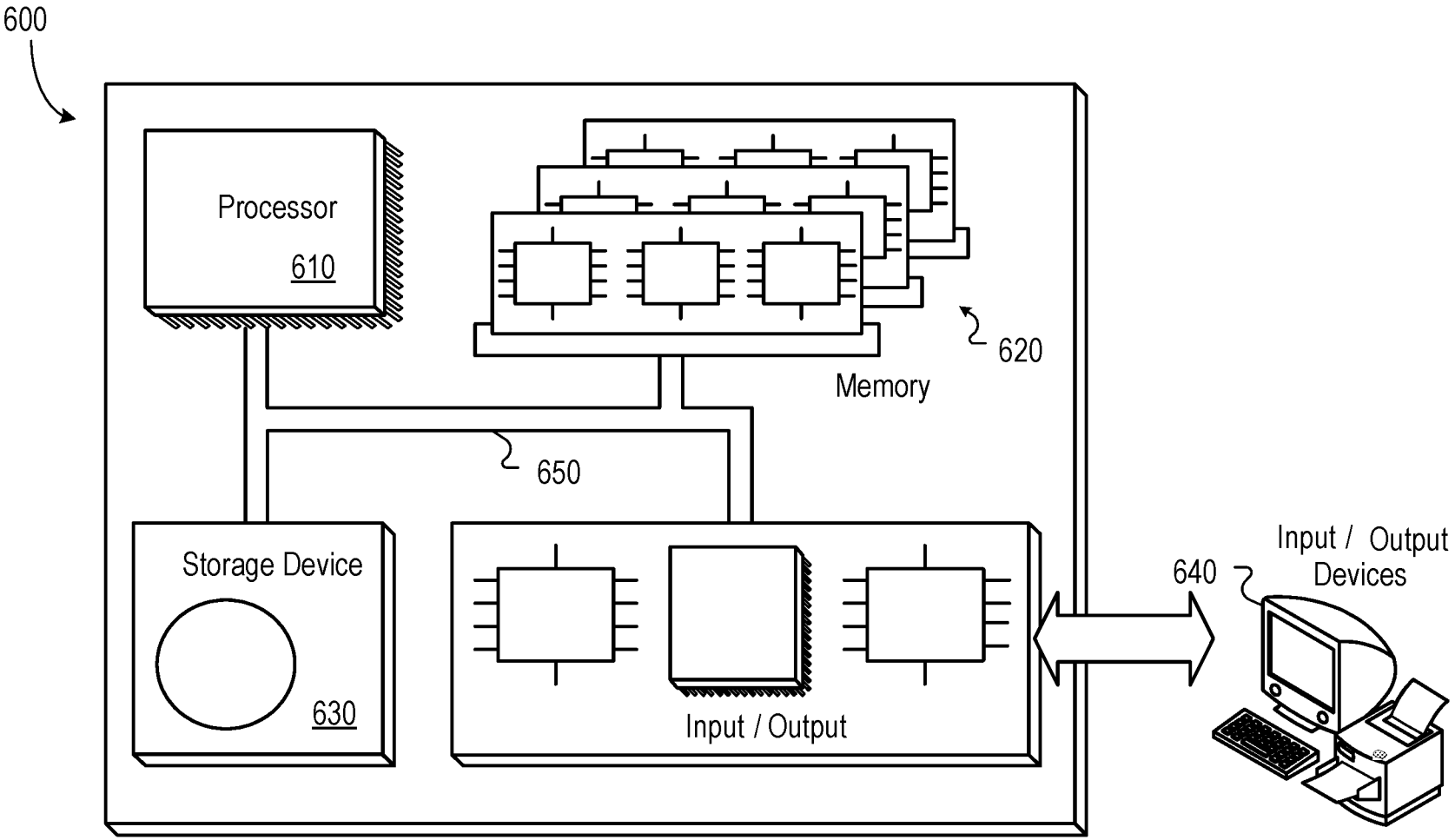
FIG. 6 is a schematic illustration of an example safety-certified controller for a HIPS for a hydrocarbon delivery system according to the present disclosure.

FIG. 6 is a schematic illustration of an example safety-certified controller 600 (or control system) for a HIPS, such as one or all of HIPS 200, 300, 400, or 500, or another HIPS according to the present disclosure. For example, the safety-certified controller 600 may include all or part of one of the safety-certified controllers 202, 302, 402, or 502 shown and described with reference to FIGS. 2-5. The safety-certified controller 600 is intended to include various forms of digital computers, such as printed circuit boards (PCB), processors, digital circuitry, or otherwise that is part of a vehicle. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The safety-certified controller 600 includes a processor 610, a memory 620, a storage device 630, and an input/output device 640. Each of the components 610, 620, 630, and 640 are interconnected using a system bus. The processor 610 is capable of processing instructions for execution within the safety-certified controller 600. The processor may be designed using any of a number of architectures. For example, the processor 610 may be a CISC (Complex Instruction Set Computers) processor, a RISC (Reduced Instruction Set Computer) processor, or a MISC (Minimal Instruction Set Computer) processor.

In one implementation, the processor 610 is a single-threaded processor. In another implementation, the processor 610 is a multi-threaded processor. The processor 610 is capable of processing instructions stored in the memory 620 or on the storage device 630 to display graphical information for a user interface on the input/output device 640.

The memory 620 stores information within the safety-certified controller 600. In one implementation, the memory 620 is a computer-readable medium. In one implementation, the memory 620 is a volatile memory unit. In another implementation, the memory 620 is a non-volatile memory unit.

The storage device 630 is capable of providing mass storage for the safety-certified controller 600. In one implementation, the storage device 630 is a computer-readable medium. In various different implementations, the storage device 630 may be a floppy disk device, a hard disk device, an optical disk device, or a tape device.

The input/output device 640 provides input/output operations for the safety-certified controller 600. In one implementation, the input/output device 640 includes a keyboard and/or pointing device. In another implementation, the input/output device 640 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method for managing a hydraulic fluid pipeline pressure, comprising:

measuring a fluid pressure of a hydrocarbon fluid circulating, from a wellbore by a pump positioned in the wellbore, through an above-ground hydrocarbon fluid pipeline network at a plurality of particular locations in the hydrocarbon fluid pipeline network to determine a plurality of measured process pressures, the plurality of particular locations positioned in a downstream hydrocarbon piping system of the above-ground hydrocarbon fluid pipeline network that is coupled to an outlet of a spec break valve that separates the downstream hydrocarbon piping system from an upstream hydrocarbon piping system of the above-ground hydrocarbon fluid pipeline network that is coupled to an inlet of the spec break valve, the upstream hydrocarbon piping system comprising a maximum pressure rating at least equal to a deadhead pressure of the wellbore or the pump;

determining that at least half of the plurality of measured process pressures exceed a specified threshold value that is no greater than a maximum allowable operating pressure (MAOP) rating of the downstream hydrocarbon piping system, the MAOP rating less than the deadhead pressure;

based on the determination, actuating at least one flow control device; and controlling the flow of the hydrocarbon fluid in the wellbore with the actuated at least one flow control device to reduce a fluid pressure of the hydrocarbon fluid in the hydrocarbon fluid pipeline network.

2. The method of claim 1, wherein actuating at least one flow control device comprises adjusting at least one of a motor controller of the pump, a downhole valve fluidly coupled to a work string that comprises the pump, or a power switchgear module electrically coupled to the pump.

3. The method of claim 2, wherein actuating at least one of a motor controller of the pump, a downhole valve fluidly coupled to a work string that comprises the pump, or a power switchgear module electrically coupled to the pump comprises at least one of:

actuating the downhole valve to a closed position to fluidly decouple the pump from the hydrocarbon fluid pipeline network;

adjusting the motor controller to slow down or stop the pump; or de-energizing a relay that is electrically coupled to the power switchgear module to electrically decouple the motor controller from the power switchgear module.

4. The method of claim 3, wherein adjusting the motor controller to slow down or stop the pump comprises adjusting an adjustable frequency drive that is electrically coupled to a motor of the pump.

5. The method of claim 3, wherein adjusting the downhole valve to the closed position to fluidly decouple the pump from the hydrocarbon fluid pipeline network comprises:

transmitting at least one signal to a solenoid valve that is fluidly coupled to a fluid actuator of the downhole valve;

based on the signal, bleeding a fluid from the fluid actuator; and based on bleeding the fluid, actuating the downhole valve to move to the closed position.

6. The method of claim 1, wherein the pump comprises an electrical submersible pump.

7. The method of claim 1, wherein the plurality of particular locations comprise at least three particular locations, and the plurality of measured process pressures comprise at least three measured process pressures.

8. A hydrocarbon pipeline protection system, comprising:

a plurality of process pressure sensors configured to couple to an above-ground hydrocarbon fluid pipeline that is fluidly coupled to a wellbore that extends from a terranean surface into a subterranean zone, where the hydrocarbon fluid pipeline comprises a downstream hydrocarbon piping system that is coupled to an outlet of a spec break valve that separates the downstream hydrocarbon piping system from an upstream hydrocarbon piping system of the hydrocarbon fluid pipeline that is coupled to an inlet of the spec break valve, the upstream hydrocarbon piping system comprising a maximum pressure rating at least equal to a deadhead pressure of the wellbore or a pump positioned in the wellbore; and a controller configured to communicably couple to the plurality of process pressure sensors and at least one flow control device positioned to adjust a flow of a hydrocarbon fluid that is circulated, by the pump positioned in the wellbore, from the subterranean zone, through the wellbore, and into the hydrocarbon fluid pipeline, the controller configured to perform operations comprising:

receiving a fluid pressure measurement from each of the plurality of process pressure sensors;

determining that at least half of the plurality of process pressure measurements exceed a specified threshold value that is no greater than a maximum allowable operating pressure (MAOP) rating of the downstream hydrocarbon piping system, the MAOP rating less than the deadhead pressure; and based on the determination, controlling the at least one flow control device to control the flow of the hydrocarbon fluid in the wellbore to reduce a fluid pressure of the hydrocarbon fluid in the hydrocarbon fluid pipeline.

9. The hydrocarbon pipeline protection system of claim 8, wherein the operation of controlling the at least one flow control device comprises adjusting at least one of a motor controller of the pump, a downhole valve fluidly coupled to a work string that comprises the pump, or a power switchgear module electrically coupled to the pump.

10. The hydrocarbon pipeline protection system of claim 9, wherein the operation of adjusting at least one of the motor controller of the pump, the downhole valve fluidly coupled to the work string that comprises the pump, or the power switchgear module electrically coupled to the pump, comprises performing, with the controller, at least one operation comprising:

adjusting the downhole valve to a closed position to fluidly decouple the pump from the hydrocarbon fluid pipeline;

adjusting the motor controller to slow down or stop the pump; or de-energizing a relay that is electrically coupled to the power switchgear module to electrically decouple the motor controller from the power switchgear module.

11. The hydrocarbon pipeline protection system of claim 10, wherein the operation of adjusting the motor controller to slow down or stop the pump comprises electrically isolating, with the controller, an adjustable frequency drive that is electrically coupled to a motor of the pump to stop the pump.

12. The hydrocarbon pipeline protection system of claim 10, wherein the operation of adjusting the downhole valve to the closed position to fluidly decouple the pump from the hydrocarbon fluid pipeline comprises:

transmitting, from the controller, at least one signal to a solenoid valve that is fluidly coupled to a fluid actuator of the downhole valve, the signal comprising an instruction to bleed a fluid from the fluid actuator to move the downhole valve to the closed position.

13. The hydrocarbon pipeline protection system of claim 9, wherein the pump comprises an electrical submersible pump.

14. The hydrocarbon pipeline protection system of claim 8, wherein the plurality of process pressure sensors comprise at least three process pressure sensors.

15. The hydrocarbon pipeline protection system of claim 14, wherein at least half of the received plurality of hydrocarbon process pressure measurements comprise at least two out of three hydrocarbon process pressure measurements.

16. A computer-implemented method of managing a hydrocarbon piping network pressure, comprising:

receiving, at a controller that comprises at least one hardware processor, a plurality of hydrocarbon process pressure measurements from a plurality of pressure sensors mounted downstream of a spec break valve in a hydrocarbon fluid pipeline fluidly coupled to a wellbore, wherein a first pressure rating of the hydrocarbon fluid pipeline upstream of the spec break valve is at least equal to a deadhead pressure of the wellbore or an electrical submersible pump positioned in the wellbore, and a second pressure rating of the hydrocarbon fluid pipeline downstream of the spec break valve is a maximum allowable operating pressure rating that is less than the first pressure rating;

determining, with the controller, that at least half of the received plurality of hydrocarbon process pressure measurements exceed a value that is greater than the maximum allowable operating pressure of the hydrocarbon fluid pipeline downstream of the spec break valve; and based on the determination, transmitting at least one signal, from the controller, to at least one of a motor controller of the electrical submersible pump, a switchgear relay electrically coupled to the electrical submersible pump, or a downhole valve actuator, to reduce a flow rate of a hydrocarbon fluid in the hydrocarbon fluid pipeline.

17. The computer-implemented method of claim 16, wherein the at least one signal is transmitted to at least the motor controller and, based on receipt of the signal, the motor controller performs at least one of disconnecting electrical power to the electrical submersible pump or reducing an operational speed of the electrical submersible pump.

18. The computer-implemented method of claim 16, wherein the at least one signal is transmitted to at least the downhole valve actuator and, based on receipt of the signal, a downhole valve adjusts to a closed position to substantially stop of the flow rate of the hydrocarbon fluid in the hydrocarbon fluid pipeline.

19. The computer-implemented method of claim 16, wherein the at least one signal is transmitted to at least the switchgear relay and, based on receipt of the signal, the switchgear relay commands a power switchgear to disconnect electrical power to the electrical submersible pump.

20. The computer-implemented method of claim 16, wherein the plurality of pressure sensors comprise at least three pressure sensors.

21. The computer-implemented method of claim 20, wherein at least half of the received plurality of hydrocarbon process pressure measurements comprise at least two out of three hydrocarbon process pressure measurements.

* * * * *